United States Patent [19]

Morris et al.

[11] Patent Number: 4,621,220

[45] Date of Patent: Nov. 4, 1986

[54] INCANDESCENT LAMP HAVING TWO LEAD-IN CONDUCTORS SEALED WITHIN ONE END THEREOF

[75] Inventors: Merle E. Morris, Lexington; Steven L. Meade, Winchester; Stephen P. Senft, Lexington, all of Ky.

[73] Assignee: GTE Products Corporation, Stamford, Conn.

[21] Appl. No.: 575,965

[22] Filed: Feb. 1, 1984

[51] Int. Cl.[4] ..... H01J 5/48; H01J 5/50

[52] U.S. Cl. ..... 313/318; 313/315; 313/274; 313/275; 313/279; 313/269; 313/285; 313/579

[58] Field of Search ..... 313/318, 271, 274, 275, 313/279, 579, 315, 316, 269, 285

[56] References Cited

U.S. PATENT DOCUMENTS

| | | | |
|---|---|---|---|
| 3,493,808 | 2/1970 | McClusky et al. | 313/274 |
| 3,502,931 | 3/1970 | Mosby | 313/275 |
| 3,555,342 | 1/1971 | McFall | 313/318 |
| 3,760,217 | 9/1973 | Martin et al. | 313/279 |
| 3,891,885 | 6/1975 | Wurster | 313/275 |
| 3,912,960 | 10/1975 | Danko | 313/271 |
| 4,442,374 | 4/1984 | Morris et al. | 313/274 |

FOREIGN PATENT DOCUMENTS

| | | | |
|---|---|---|---|
| 0593269 | 2/1978 | U.S.S.R. | 313/271 |

*Primary Examiner*—David K. Moore

*Attorney, Agent, or Firm*—Lawrence R. Fraley

[57] ABSTRACT

A tungsten-halogen lamp including a tubular quartz envelope wherein both of the lead-in conductors designed for providing electrical energy to the lamp's coiled filament are strategically positioned within a single, press-sealed end portion of the lamp's envelope. Electrical connections to the lamp may thus be provided and only one end thereof to thereby facilitate positioning and connection of the lamp within a photocopier or similar machine.

7 Claims, 2 Drawing Figures

INCANDESCENT LAMP HAVING TWO LEAD-IN CONDUCTORS SEALED WITHIN ONE END THEREOF

TECHNICAL FIELD

This invention relates generally to electric incandescent lamps, and more particularly to tubular lamps having axially extending coiled filaments therein. Still further, the invention relates to tungsten-halogen lamps of this type wherein the opposing ends of the tubular envelope are press-sealed.

BACKGROUND

Examples of tungsten-halogen incandescent lamps having opposed press-sealed end portions are known in the art. Examples are described and illustrated in U.S. Pat. Nos. 3,392,299 (Kern), 3,443,144 (Freese, Jr.) 3,602,761 (Kimball), 3,943,395 (Huston et al), and 4,359,665 (Morse et al), all of which are assigned to the same assignee as the instant invention. It will be understood from the following that this invention is particularly adapted to lamps of the above type which are especially suited for use in photocopiers. One particular example is shown and described in the aforementioned U.S. Pat. No. 3,943,395.

In 3,943,395, there is described a lamp including a tubular glass envelope having opposed press-sealed end portions, each of which contain the respective lead-in conductors which, when connected to the photocopier's power source (i.e., 110 VAC), provides electrical energy to the lamp's filament to cause activation thereof. As shown in this patent, lamps of this variety typically include an end cap of ceramic or the like material located on each of the press-sealed ends. These end caps are inserted within the corresponding connectors within the photocopier and connection is made at each end. One particular problem in such an arrangement is that many photocopier machines provide little accessibility at one of these connector locations, in effect, creating a "blind side". Providing positive electrical connection at these locations has thus proven somewhat difficult.

It is believed, therefore, that a tubular incandescent lamp of the type described wherein all electrical connections necessary to accomplish activation of the lamp are made at only one end thereof would constitute a significant advancement in the art. As such, it would only then be necessary to provide a suitable non-electrical connector or the like in this "blind side" region of the photocopier, whereupon mere insertion of such a lamp therein would be possible without requiring electrical connection thereat. The instant invention is thus readily adaptable for use in many of today's photocopier machines without the requirement for extensive modification thereto.

DISCLOSURE OF THE INVENTION

It is, therefore, a primary object of this invention to enhance the incandescent lamp art and particularly that art involving incandescent lamps having elongated tubular envelopes wherein the filament axially extends therethrough.

It is another object of the this invention to provide an improved incandescent lamp wherein said lamp is readily adapted for use within a photocopier machine or the like.

Still another object of the invention is to provide an improved incandescent lamp of the variety defined which can be produced at relatively little cost and on a mass production basis.

In accordance with one aspect of this invention, there is defined an improved incandescent lamp which includes a tubular envelope having first and second press-sealed end portions, a coiled filament extending longitudinally through the envelope's interior, and first and second lead-in conductors each of which extend within the envelope and are electrically connected to a respective one of the filament's ends. Both lead-in conductors are positioned within the first press-sealed end of the tubular envelope in a spaced-apart relationship such that electrical connections for providing electrical energy to the lamp's filament can be attached to the lamp at only the first press-sealed end portion of the envelope.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
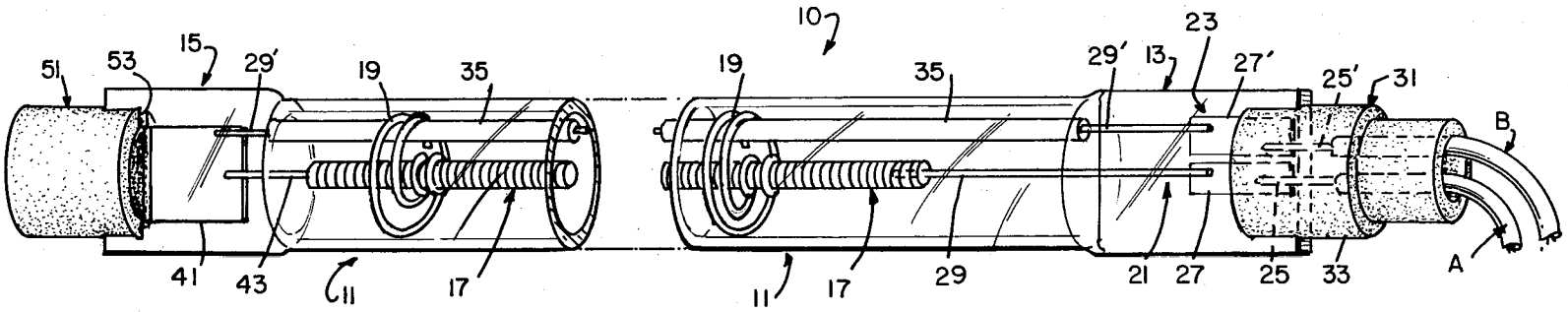
FIG. 1 is a side view, partly in section, illustrating one embodiment of the instant invention.
Figure 2:
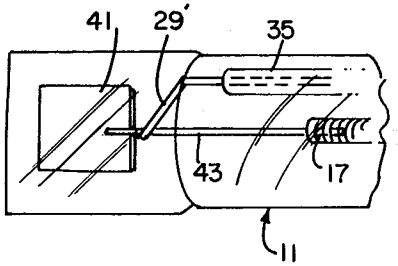
FIG. 2 is a partial side view of the invention, illustrating an alternate embodiment thereof.

With particular attention to FIG. 1, the lamp 10 illustrated therein comprises a tubular envelope 11 of vitreous material having first and second press-sealed end portions 13 and 15, respectively. Ends 13 and 15, as illustrated, are located at opposite ends of the elongated tubular envelope and are thus substantially spaced apart by the interior (hollow) portion of the envelope. Formation of these press sealed end portions is accomplished utilizing pressing operations and apparatus known in the art and further description is not believed necessary. Because envelope 11 will attain elevated temperatures during operation of lamp 10, it is preferred that the material for the envelope possess a relatively high melting point. Examples include fused silia, or quartz, or Vycor (containing approximately ninety-six percent silica). High melting point glasses such as borosilicate or aluminosilicate may also be suitable.

Lamp 10, as indicated previously, is of the tungsten-halogen variety. As such, envelope 11 contains therein a halogen additive, such as iodine or bromine, which functions as a regenerative getter to return to the lamp's axially extending coil tungsten filament 17 quantities of tungsten which may be vaporized therefrom during lamp operation. Envelope 11 preferably also contains an inert gas such as nitrogen, argon, krypton or xenon at substantial pressure (i.e., greater than one atmosphere).

Filament 17, as stated, is of tungsten material and, as illustrated, is substantially centrally disposed within the interior of envelope 11. Filament 17 is of coiled configuration. By this is meant that the filament may comprise a singular elongated coiled element or, alternatively, what is known in the art as a coiled-coil element. Examples are illustrated in the aforementioned patents (i.e., 3,392,299). Supporting the filament at preselected points along the length thereof are a plurality of support members 19 which, as illustrated, each comprise a coil element having one end wound about (and thus secured to) the filament and the other end (of greater diameter) positively engaging the interior wall of envelope 11. The number of filament support members 19 utilized in lamp 10 is dependent on the overall length of envelope 11 (and, therefore, filament 17). In one example of the invention, a total number of 16 support members 19 was utilized, each of tungsten wire having an outer diameter of about 0.325 inch. In this same example, envelope 11 possessed an overall length of about 19 inches and tungsten filament 17 possessed an overall length of about 11.50 inches. Of this total envelope length, each of the press-sealed end portions 13 and 15 possessed an overall length of about 0.55 inch.

Although it has been stated that one material for support members 19 is tungsten, it is within the scope of this invention to utilize other materials, such as an alloy of tungsten and rhenium (about ninety-seven percent tungsten and three percent rhenium), said material described in the aforementioned U.S. Pat. No. 3,392,299.

Prior art lamps of the aforementioned variety, including those illustrated in the above patents, typically include means for providing electrical connection to the lamp's filament each located within each of the opposing ends of the lamp's elongated envelope. As stated, such an arrangement necessitates providing electrical contact at a location somewhat difficult to reach in many photocopier machines. Accordingly, the instant invention uniquely provides means for electrically connecting the lamp described herein at only one end thereof to thus enable an individual positioning such a lamp within a photocopier to provide connection thereto in an effective, facile and relatively safe manner.

In accordance with the present invention, lamp 10 is illustrated in FIG. 1 as including a pair of lead-in conductors 21 and 23 which are securedly positioned in a spaced-apart (and, therefore, electrically insulated) manner within the first press-sealed end portion 13 of tubular envelope 11. It is thus possible to provide connection to only end 13 (and thus to both conductors 21 and 23) to achieve activation of filament 17.

The first lead-in conductor, hereinafter referred to by the numeral 21, includes an outer portion 25, preferably of molybdenum wire having a diameter of about 0.030 inch, an intermediate foil portion 27, also preferably of molybdenum and of the rectangular configuration illustrated, and an inner portion 29, preferably of tungsten wire having a diameter of about 0.025 inch. Intermediate foil 27 is hermetically sealed within the first press-sealed end 13 during the press-sealing operation after having both inner and outer portions affixed (i.e., welded) thereto. As illustrated, outer portion 25 extends exteriorly from envelope 11 and is thus readily adapted for being electrically connected to an external electrical connection (contact terminal A). Inner portion 29 extends interiorly of envelope 11 and is connected to the end of filament 17 nearest the first press-sealed end 13. This connection may be accomplished by winding the coil filament about a predetermined length of the end of inner portion 29 and thereafter welding these two elements.

Second lead-in conductor 23, designed for being electrically connected to the opposing end of filament 17, also includes an outer portion 25', preferably of similar diameter molybdenum wire as outer portion 25, an intermediate rectangular-shaped foil portion 27' similar in size to foil 27, and an inner 29'. As illustrated, intermediate foil portion 27' is also hermetically sealed within the first press-sealed end 13 and has connected thereto (also preferably by welding) the end segments of outer and inner portions 25' and 29', respectively. Outer portions 25', as illustrated, is designed for being electrically connected to a second electrical connection (contact terminal B). Both contact terminals A and B can be positioned within an insulative (e.g., ceramic) end cap member 31 to provide these necessary connections. Cap member 31 preferably includes an enlarged cylindrical portion 33 possessing a slot for the like therein. This slot (not shown) is specifically designed for having the flattened (rectangular in cross-section) end 13 inserted therein.

Inner portion 29' of second lead-in conductor 23, like inner portion 29 of the first lead-in connector, also is preferably in the form of a conductive wire. Unlike inner portion 29, however, inner portion 29' is preferably of molybdenum wire having a diameter of about 0.025 inch and extends longitudinally through the interior of envelope 11 and into the opposing second press-sealed end portion 15. Inner portion 29' is also located substantially parallel to the coiled filament 17 and spaced therefrom. In addition, inner portion 29' is positioned substantially within a tubular, insulative member 35. In one embodiment, member 35 comprised a tubular glass member of cylindrical configuration having an outer diameter of about 0.080 inch. Insulative member 35 passes through the coiled support members 19 in the manner shown and thus does not contact the interior surfaces of envelope 11. It is also illustrated that the insulative member 35 has both of its end portions immediately adjacent the respective press-sealed end of envelope 11 and therefore provides insulation for the conductive inner portion 29' across substantially the entire interior of envelope 11.

Inner portion 29', as stated, extends within the second press-sealed end portion 15 of envelope 11. As also illustrated in FIG. 1, inner portion 29' is electrically connected to a foil element 41, preferably of molybdenum, which element has been hermetically sealed within end 15. Inner portion 29' is preferably connected thereto by welding. Electrical connection to the opposing end of filament 17 is provided by a conducting wire member 43 which is joined at one end to the foil element 41 within end 15 and at the other end is electrically connected to filament 17. This latter connection is preferably accomplished in the same manner described for inner portion 29. Conducting member 43 is preferably tungsten wire having an outer diameter of about 0.025 inch. In one embodiment, the foil element 41, of the rectangular configuration shown, possessed a length of about 0.375 inch, a width of about 0.163 inch and a thickness of only about 0.002 inch. The connections of inner portion 29' and conducting member 43 were made thereto prior to sealing of the foil element within end portion 15.

To facilitate positioning of lamp 10 within the photocopier designed for utilizing same, a ceramic end cap 51 is preferably used. Accordingly, it is only necessary in the respective photocopier to provide some means for accepting this component. Understandably, such a means can be of relatively simply design. End cap member 51 is also preferably of substantially cylindrical configuration and includes a slot 53 therein designed for having the flattened second press-sealed end portion 15 inserted therein.

In accordance with the alternate embodiment of the invention, the end part of inner portion 29' of the second lead-in conductor 23 is bent such that it provides direct electrical connection to conducting wire member 43. Preferably, this connection is achieved by welding. It is thus only necessary to connect (e.g., by welding) the end of conducting member 43 to foil element 41, thus facilitating assembly of this portion of the invention, as well as assuring positive electrical connection between inner portion 29' and member 43. As shown in FIG. 1, foil element 41 is larger in area than either of the intermediate foil elements 27 and 27'.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an incandescent lamp including a long, small diameter tubular envelope having first and second press-sealed end portions, a coiled filament extending longitudinally through the interior of said envelope, at least one filament support member located within said envelope for supporting said filament within said envelope at a location between the ends of said filament and first and second lead-in conductors, each of said lead-in conductors extending within said envelope and electrically connected to a respective one of the ends of said coiled filament, the improvement wherein both of said lead-in conductors are positioned within said first press-sealed end portion of said envelope in a spaced-apart relationship to thereby enable electrical connections for providing electrical energy sufficient to activate said filament to be attached to said incandescent lamp at only said first press-sealed end portion, said first lead-in conductor electrically connected to said end of said filament nearest said first press-sealed end portion of said envelope and said second lead-in conductor connected to said end of said filament nearest said second press-sealed end portion of said envelope, said second lead-in conductor including a conductive wire inner portion extending longitudinally through said interior of said envelope substantially parallel to said filament and extending within said second pess-sealed end portion of said envelope, a singular foil element hermetically sealed within said second press-sealed end portion, and a conducting wire member electrically connected to said foil element within said second press-sealed end portion and extending within said envelope for being electrically connected to said end of said filament nearest said second press-sealed end portion, said lamp further including a tubular, electrically insulative member located within said interior of said envelope and extending substantially the entire length thereof, said insulative member passing through and engaged by said filament support member while being spaced from and substantially parallel to said coil filament, said conductive wire inner portion of said second lead-in conductor being positioned within said tubular insulative member.

2. The improvement according to claim 1 wherein each of said first and second lead-in conductors comprises an outer portion extending exteriorly of said first press-sealed end portion and adapted for having a respective one of said electrical connections connected thereto and an intermediate foil portion hermetically sealed within said first press-sealed end portion and electrically connected to said outer portion, said first lead-in conductor further including an inner portion electrically connected to said foil portion of said first lead-in conductor and extending within said interior of said envelope, said inner portion being electrically connected to said respective end of said filament nearest said first press-sealed end portion of said envelope, said conductive wire inner portion of said second lead-in conductor electrically connected to said foil portion of said second lead-in conductor.

3. The improvement according to claim 1 wherein said tubular insulative member is glass and said inner portion of said second lead-in conductor positioned within said tubular insulative member comprises a molybdenum wire.

4. The improvement according to claim 1 wherein said filament support member comprises a coil element having one end portion thereof wound about said filament and a second end portion thereof engaging the interior wall of said envelope.

5. The improvement according to claim 1 wherein said conductive wire inner portion of said second lead-in conductor is directly connected to said singular conductive foil element within said second press sealed end portion of said envelope.

6. The improvement according to claim 1 wherein said conductive wire inner portion of said second lead-in conductor is directly connected to said conductive wire member within said second press sealed end portion of said envelope.

7. The improvement according to claim 2 wherein said singular conductive foil element within said second press sealed end portion of said envelope is larger than either of said intermediate foil portions of said first and second lead-in conductors.

* * * * *